US011519407B2

(12) United States Patent
Goy et al.

(10) Patent No.: US 11,519,407 B2
(45) Date of Patent: Dec. 6, 2022

(54) DUAL VANE PUMP WITH PRE-PRESSURIZATION PASSAGES

(71) Applicant: Hamilton Sundstrand Corporation, Charlotte, NC (US)

(72) Inventors: Edward W. Goy, Crystal Lake, IL (US); Timothy J. Franckowiak, Rockford, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 85 days.

(21) Appl. No.: 17/078,241

(22) Filed: Oct. 23, 2020

(65) Prior Publication Data

US 2022/0128051 A1 Apr. 28, 2022

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 11/00*** | (2006.01) |
| ***F04C 13/00*** | (2006.01) |
| ***F04C 2/344*** | (2006.01) |
| ***F04C 2/348*** | (2006.01) |
| ***F04C 14/22*** | (2006.01) |
| ***F04C 23/00*** | (2006.01) |

(52) U.S. Cl.

CPC ..... *F04C 11/001* (2013.01); *F04C 2/344* (2013.01); *F04C 2/348* (2013.01); *F04C 14/226* (2013.01); *F04C 23/001* (2013.01); *F04C 2210/206* (2013.01); *F04C 2240/50* (2013.01)

(58) Field of Classification Search

CPC ..... F04C 2/344; F04C 2/348; F04C 2/3442; F04C 11/001; F04C 23/001; F04C 2210/206; F04C 2240/50

See application file for complete search history.

(56) References Cited

U.S. PATENT DOCUMENTS

| | | | | |
|---|---|---|---|---|
| 2,584,426 A | | 2/1952 | Crane | |
| 2,745,348 A | | 5/1956 | Rueter | |
| 3,150,646 A | * | 9/1964 | Springer | F04C 2/344 418/259 |
| 3,430,574 A | | 3/1969 | Adelman | |

(Continued)

FOREIGN PATENT DOCUMENTS

| | | | |
|---|---|---|---|
| JP | S50109503 | A | 8/1975 |
| JP | 2015178791 | A | 10/2015 |

OTHER PUBLICATIONS

European Search Report for EP Application No. 21204317.8 dated Mar. 22, 2022.

*Primary Examiner* — Theresa Trieu

(74) *Attorney, Agent, or Firm* — Carlson, Gaskey & Olds, P.C.

(57) ABSTRACT

A dual vane pump system includes first and second vane pumps having first and second rotors with a plurality of vanes moving radially inwardly and outwardly of the first and second rotors, and into contact with an inner surface of the first and second outer liners. A first pre-pressurization passage connects a first pump inlet in the first pump that is at discharge pressure to a second pump outlet in the second pump which is upstream of the second discharge opening. There is a coupling connecting the first and second rotors for rotation together. The pre-pressurization passage extending through the bearing.

20 Claims, 3 Drawing Sheets

(56) References Cited

U.S. PATENT DOCUMENTS

| | | | | |
|---|---|---|---|---|
| 3,707,339 | A * | 12/1972 | Budgen | F04C 23/001 418/13 |
| 5,431,552 | A * | 7/1995 | Schuller et al. | F04C 2/3441 418/268 |
| 8,668,480 | B2 | 3/2014 | Dennis et al. | |
| 9,546,728 | B2 | 1/2017 | Schultz et al. | |
| 2012/0070327 | A1 | 3/2012 | Dennis et al. | |
| 2016/0123323 | A1 | 5/2016 | Naiki et al. | |

* cited by examiner

DUAL VANE PUMP WITH PRE-PRESSURIZATION PASSAGES

BACKGROUND

This application relates to a dual vane pump with pre-pressurization passages.

Vane pumps are known, and typically include a rotor rotating within a liner. A cam surface within the liner is positioned eccentrically relative to a rotational axis of the rotor. Vanes extend radially inwardly and outwardly of the rotor, and in contact with the cam surface. Movement of the vanes along the cam surface causes the vanes to move inwardly and outwardly and move a pump fluid from a suction or inlet to a discharge or outlet through pump chambers defined between the vanes.

When the pump chamber communicates with a discharge window opening, an immediate increase in pressure creates rapid decrease in air volume. Pre-pressurization has been utilized in the past to provide a "step change" in the overall volume reduction and pressure increase. Pre-pressurization occurs by introducing pressurized fluid into the pump chambers prior to the chambers communicating with the full discharge opening. With this, there is a stepdown to an intermediate air volume and increase in pressure.

SUMMARY

A dual vane pump system includes a first vane pump having a first outer liner, a first rotor with a first plurality of vanes moving radially inwardly and outwardly of the first rotor, and into contact with an inner surface of the first outer liner. The first vane pump has a first suction opening extending through the first outer liner and a first discharge opening extending through the first outer liner. A second vane pump has a second outer liner, a second rotor with a second plurality of vanes moving radially inwardly and outwardly of the second rotor, and into contact with the second inner surface of the second outer liner. The second vane pump has a second suction opening extending through the second outer liner and a second discharge opening extending through the second outer liner. A first pre-pressurization passage connects a first pump inlet in the first pump that is at discharge pressure to a second pump outlet in the second pump which is upstream of the second discharge opening. There is a coupling connecting the first and second rotors for rotation together. The coupling is mounted in the journal within the bearing. The pre-pressurization passage extends through the bearing.

These and other features may be best understood from the following drawings and specification, the following is a brief description.

DETAILED DESCRIPTION

Figure 1:
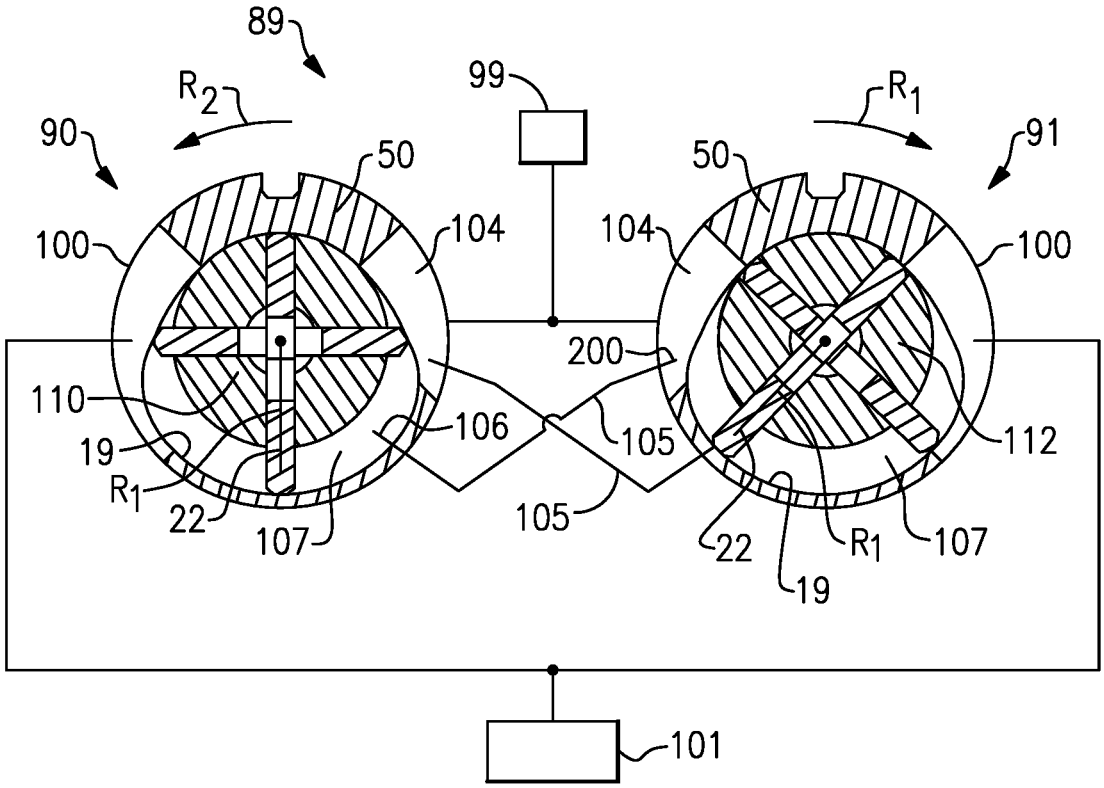
FIG. 1 shows a dual pump assembly.

FIG. 1 illustrates a dual pump 89 with a first pump 91 and a second pump 90. Both pumps are vane pumps each having a rotor 110 and 112 receiving a plurality of vanes 22. As illustrated there are four vanes in each pump 90 and 91. The vanes in the first vane pump are out of phase with the vanes in the second vane pump. As can be seen in FIG. 1, the vanes 22 associated with one pump 90 are 45 degrees out of phase with the vanes 22 associated with the other pump 91.

A liner inner surface 19 is eccentric, and cams the vanes 22 inwardly and outwardly. The rotors 110 and 112 are driven to rotate, and an entrapped fluid in pump chambers 107 between adjacent vanes is moved from a suction opening 100 towards a discharge opening 104.

In the illustrated dual pump 89 a pre-pressurization passage 105 has an inlet 200 at discharge pressure in each of the pumps 90 and 91, and extends to an outlet 106 which empties into a pump chamber 107 in the other of pumps 90 and 91. The location of features 105, 106 and 200 is shown schematically in FIG. 1. The actual location is better shown in FIG. 2. As shown, the location of the outlet 106 is such that an upstream vane 22 is already past a suction opening 100 before reaching the outlet 106. This prevents backflow between the outlet 106 and the suction opening 100. On the other hand, a downstream adjacent vane 22 has already been moving along the discharge opening 104 at this time.

As shown, the vane pumps 90 and 91 are in parallel with the discharge opening 104 communicating with a common use 99. Further, the suction openings 100 may communicate with a common source 101. In one embodiment, the source 101 provides oil to be utilized by the common use 99.

Examples of the use include a lubrication pump for an engine starter/generator, and a scavenge pump for returning lubricant back to an oil tank.

Figure 2:
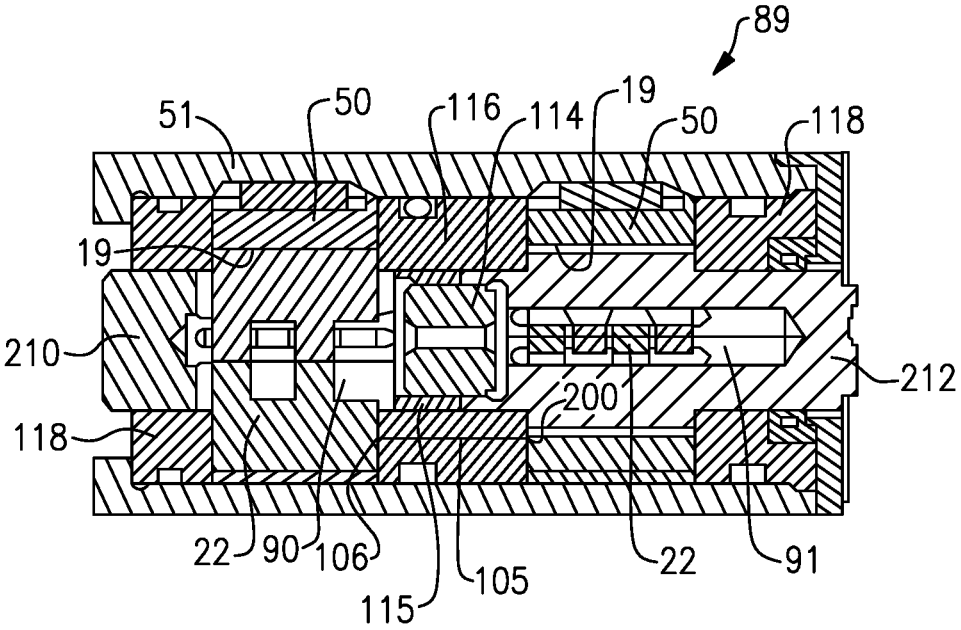
FIG. 2 is a cross-sectional view through the dual pump assembly.

FIG. 2 shows a cross-section through the dual pumps 90 and 91. As shown, a shaft 212 is formed on an opposed side of the pump 91 relative to the pump 90. That shaft is mounted in a bearing 118. The shaft 212 may be connected to a drive shaft to drive the dual vane pumps 90 and 91. A shaft 210 is on an opposed side of the pump 90 relative to the pump 91. The shaft 210 is mounted in a bearing 118. A coupling 114 connects the two rotors 110 and 112 of the pumps 90 and 91 such that they are rotated together. The two rotors 110 and 112 may thus rotate in the same direction. However, as illustrated here the rotor 110 rotates in direction $R_1$, and the rotor 112 rotates in the direction $R_2$. These directions are solely to facilitate the illustration. The coupling 114 is mounted in a journal within bearing 116 between rotors 110 and 112. A journal 115 rotates with coupling 114. The pre-pressurization passages 105 pass through bearing 116.

Since the pumps 90 and 91 are out of phase the chambers that are being connected by pre-pressurization passages 105 can be closer to being aligned than if the pumps were in phase. Thus, pre-pressurization can be a straighter shot through bearing 116.

An outer housing 51 provides a supporting surface for the journal bearings and liners 50

Figure 3A:
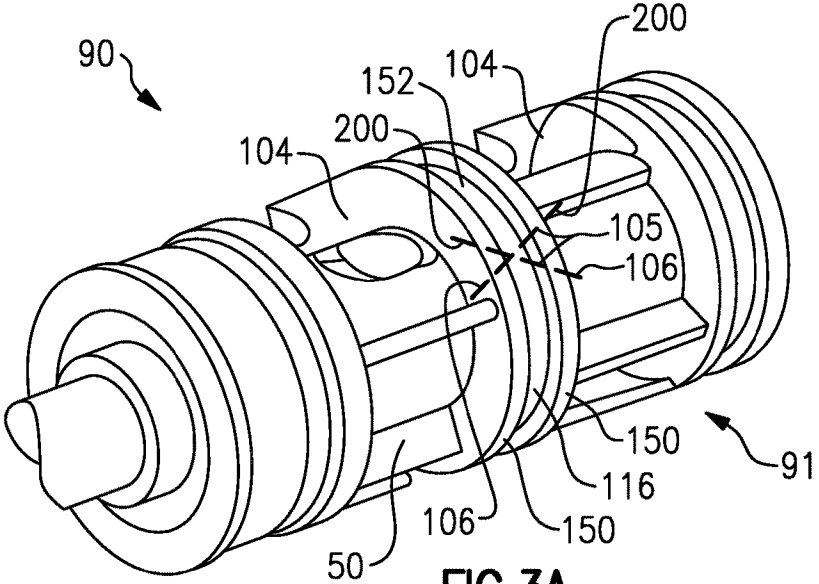
FIG. 3A is a perspective view.

FIG. 3A is a perspective view of the dual pumps 90 and 91. As shown, journal bearing 116 has enlarged portions 150 on each axial side relative to a channel 152. The pre-pressurization passages 105 pass through the bearing 116 radially inwardly of the channel 152.

Figure 3C:
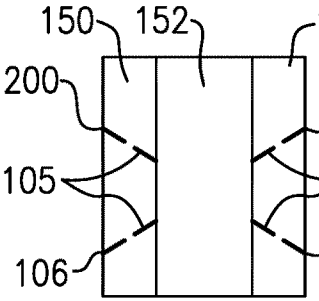
FIG. 3C shows an alternative embodiment.
Figure 3B:
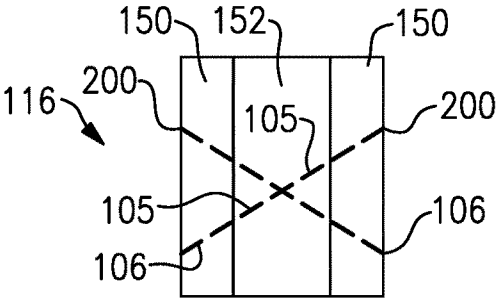
FIG. 3B show a first embodiment.

The pre-pressurization passages 105 are shown schematically in FIGS. 3A-3C. Their actual location through the bearing 116 would be designed once the particular location of the pump chambers 107 and discharge openings 104 are known. They are shown as straight lines in FIG. 3A, but they could follow a more complex path given the final design of the pumps. A worker of skill in this art, armed with this disclosure, would be able to determine a desired path.

FIG. 3B shows the bearing 116 with the pre-pressurization passages 105 in dashed line. They are beneath the surface of this Figure, and beneath an inner surface of the channel 152. The passages in the FIG. 3B embodiment are maintained separate from each other and do not intersect.

Figure 4A:
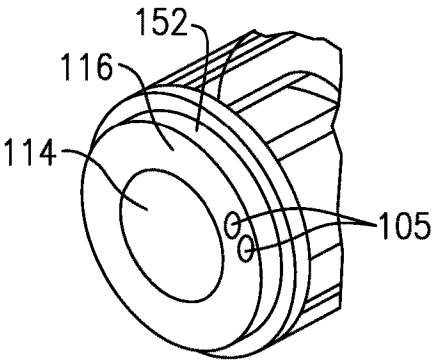
FIG. 4A shows a detail of a journal bearing.
Figure 4B:
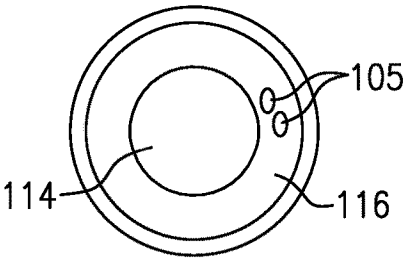
FIG. 4B shows another view of the journal bearing.

FIG. 3C shows an alternative wherein the inlets 200 and outlets 106 are formed through the enlarged portions 150, and communicate into the channel 152. The channel 152 connects to discharge 104. The channel 152 can serve to connect each of the inlets 200 to both outlets 106. FIG. 4A shows that the pre-pressurization passages 105 intersects the channel 152. This is further shown in FIG. 4B.

Figure 5:
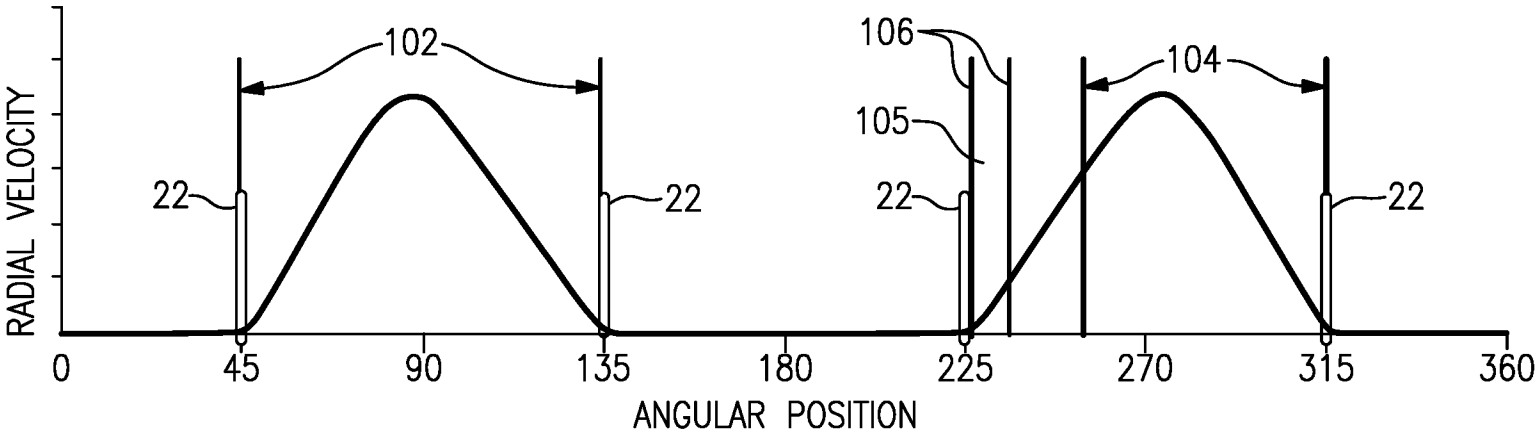
FIG. 5 is a timing chart.

FIG. 5 is a timing chart showing the upstream vane 22 has passed the suction opening 100 before reaching the outlet 106 of the pre-pressurization passage 105. This is true of both of the vane pumps 90 and 91 in a disclosed embodiment.

The inventive pump is utilized to move oil. Oil is particularly susceptible to detrimental effects from the inclusion of air, and thus benefits from the present invention. It should be understood that the invention can be utilized for any fluid that has propensity to have inclusion of air.

The introduction of the discharge pressure oil into an upstream chamber in the other pump increases the pressure, and thus the volume taken up by any entrapped air. As mentioned in the Background section above, this provides valuable benefits.

A dual vane pump system could be said to include a first vane pump having a first outer liner, a first rotor with a plurality of vanes moving radially inwardly and outwardly of the first rotor, and into contact with an inner surface of the first outer liner. The first vane pump has a first suction opening extending through the first outer liner and a first discharge opening extending through the first outer liner. A second vane pump has a second outer liner, a second rotor with a second plurality of vanes moving radially inwardly and outwardly of the second rotor, and into contact with an inner surface of the second outer liner. The second vane pump has a second suction opening extending through the second outer liner and a second discharge opening extending through the second outer liner. A first pre-pressurization passage connects a first pump inlet in the first pump that is at a discharge pressure to a second pump outlet in the second pump which is upstream of the second discharge opening. There is a coupling connecting the first and second rotors for rotation together. The coupling is mounted in the journal within the bearing. The first pre-pressurization passage extends through the first bearing.

A dual vane pump system could also be said to include a first vane pump having a first outer liner, a first rotor with a plurality of vanes moving radially inwardly and outwardly of the first rotor, and into contact with an inner surface of the first outer liner. The first vane pump has a first suction opening extending through the first outer liner and a first discharge opening extending through the first outer liner. A second vane pump has a second outer liner, a second rotor with a plurality of vanes moving radially inwardly and outwardly of the second rotor, and into contact with an inner surface of the second outer liner. The second vane pump has a second suction opening extending through the liner and a discharge opening extending through the second outer liner. A pre-pressurization passage connects an inlet at a discharge pressure in each of the first and second pumps with an outlet upstream of the discharge opening in the other of the first and second pumps.

Although an embodiment has been disclosed, a worker of ordinary skill in this art would recognize that certain modification could come within the scope of this disclosure. For these reasons, the following claims should be studied to determine the true scope and content.

What is claimed is:

1. A dual vane pump system comprising:

a first vane pump having a first outer liner, a first rotor with a first plurality of vanes moving radially inwardly and outwardly of the first rotor, and into contact with an inner surface of the first outer liner, the first vane pump having a first suction opening extending through the first outer liner and a first discharge opening extending through the first outer liner;

a second vane pump having a second outer liner, a second rotor with a second plurality of vanes moving radially inwardly and outwardly of the second rotor, and into contact with an inner surface of the second outer liner, the second vane pump having a second suction opening extending through the second outer liner and a second discharge opening extending through the second outer liner;

a first pre-pressurization passage connecting a first pump inlet in the first pump that is at a discharge pressure to a second pump outlet in the second pump which is upstream of the second discharge opening with respect to a rotation direction of the second rotor;

there being a coupling connecting the first and second rotors for rotation together, the coupling mounted in a first journal within a bearing; and the first pre-pressurization passage extending through the bearing.

2. The dual vane pump system as set forth in claim 1, wherein there is a second pre-pressurization passage connecting a second pump inlet in the second pump that is at discharge pressure to a first pump outlet in the first pump which is upstream of the first discharge opening.

3. The dual vane pump system as set forth in claim 2, wherein the bearing has opposed axially spaced enlarged portions with an intermediate channel, and the first and second pre-pressurization passages pass through the bearing at a location radially inward of an inner surface of the intermediate channel.

4. The dual vane pump system as set forth in claim 3, wherein a first shaft portion is connected to the first rotor to rotate the first rotor, and the first shaft portion is mounted in a second bearing, and the coupling then connecting the first rotor to the second rotor, and a further shaft portion being mounted on an opposed side of the second pump relative to the first pump and mounted within a third bearing.

5. The dual vane pump system as set forth in claim 4, wherein the first and second discharge openings of the first and second pumps communicate with a common use, the first and second pumps being in parallel.

6. The dual vane pump system as set forth in claim 2, wherein the bearing has axially spaced enlarged portions with an intermediate channel, and the first pump inlet and second pump inlet extending through one of the axially spaced enlarged portions and into the channel, each of the first pump outlet and second pump outlet extending through an opposed one of the first and second enlarged portions, such that fluid moves from each of the first pump and second pump inlets into the channel, and then communicates with each of the first pump outlet and the second pump outlet.

7. The dual vane pump system as set forth in claim 1, wherein the bearing has opposed axially spaced enlarged portions with an intermediate channel, and the first and second pre-pressurization passages pass through the bearing at a location radially inward of an inner surface of the channel.

8. The dual vane pump system as set forth in claim 1, wherein the bearing has axially spaced enlarged portions with an intermediate channel, and the first pump inlet and a second pump inlet extending through one of the axially spaced enlarged portions and into the channel, each of the first pump outlet and the second pump outlet extending through an opposed one of the first and the second enlarged portions, such that fluid moves from each of the first pump inlet and the second pump inlet into the channel, and then communicates with each of the first pump outlet and the second pump outlet.

9. The dual vane pump system as set forth in claim 1, wherein a first shaft portion is connected to the first rotor to rotate the first rotor, and the first shaft portion is mounted in a second bearing, and the coupling then connecting the first rotor to the second rotor, and a further shaft portion being mounted on an opposed side of the second pump relative to the first pump and mounted within a third bearing.

10. The dual vane pump system as set forth in claim 1, wherein there is an upstream vane in the second plurality of vanes and an adjacent downstream vane in the second plurality of vanes and the adjacent downstream vane is positioned such that it will have moved past the second suction opening before the upstream vane passes the outlet of the first pre-pressurization passage in the rotation direction of the second rotor.

11. The dual vane pump system as set forth in claim 1, wherein the first and second discharge openings of the first and second pumps communicate with a common use, the first and second pumps being in parallel.

12. The dual vane pump system as set forth in claim 1, wherein the first and second pumps move oil.

13. The dual vane pump system as set forth in claim 1, wherein the first plurality of vanes are out of phase with the second plurality of vanes.

14. A dual vane pump system comprising:

a first vane pump having a first outer liner, a first rotor with a first plurality of vanes moving radially inwardly and outwardly of the first rotor, and into contact with an inner surface of the first outer liner, the first vane pump having a suction opening extending through the first outer liner and a first discharge opening extending through the first outer liner;

a second vane pump having a second outer liner, a second rotor with a second plurality of vanes moving radially inwardly and outwardly of the second rotor, and into contact with an inner surface of the second outer liner, the second vane pump having a first suction opening extending through the second outer liner and a second discharge opening extending through the second outer liner; and wherein a pre-pressurization passage connects an inlet at a discharge pressure in each of the first and second pumps with an outlet upstream of the discharge opening in the other of the first and second pumps with respect to a rotation direction of each of the first and second rotors.

15. The dual vane pump system as set forth in claim 14, wherein the first plurality of vanes in the first vane pump are out of phase with the second plurality of vanes in the second vane pump.

16. The dual vane pump system as set forth in claim 15, wherein the first plurality of vanes are 45 degrees out of phase relative to the second plurality of vanes.

17. The dual vane pump system as set forth in claim 16, wherein the first and second discharge openings of the first and second pumps communicate with a common use, the first and second pumps being in parallel.

18. The dual vane pump system as set forth in claim 17, wherein the first and second pumps move oil.

19. The dual vane pump system as set forth in claim 14, wherein the first and second discharge openings of the first and second pumps communicate with a common use, the first and second pumps being in parallel.

20. The dual vane pump system as set forth in claim 14, wherein the first and second pumps move oil.

* * * * *